United States Patent [19]

Carter

[11] Patent Number: 4,554,886

[45] Date of Patent: Nov. 26, 1985

[54] APPARATUS FOR COATING AND CUTTING SHEET MATERIAL

[76] Inventor: Carlos R. Carter, 6648 Wealthy Ct., Riverdale, Ga. 30274

[21] Appl. No.: 583,707

[22] Filed: Feb. 27, 1984

[51] Int. Cl.[4] ..... B05C 3/18; B05C 5/02

[52] U.S. Cl. ..... 118/42; 118/415; 118/DIG. 17

[58] Field of Search ..... 118/DIG. 17, 415, 42, 118/413, 419

[56] References Cited

U.S. PATENT DOCUMENTS

| | | | |
|---|---|---|---|
| 1,725,261 | 8/1929 | Ernst | 118/415 |
| 2,057,264 | 10/1936 | Pierce | 118/415 X |
| 2,620,767 | 12/1952 | Lehman | 118/13 X |

*Primary Examiner*—John P. McIntosh

*Attorney, Agent, or Firm*—Newton, Hopkins & Ormsby

[57] ABSTRACT

An apparatus for coating a wall covering with paste or other adhesive and for cutting the coated covering at its desired length. A coating station, having wall covering supply roll supports, for applying adhesive to the back of a wall covering and a cutting station for cutting the coated covering material at its desired length are fixed to an articulated foldable work table generally at one end thereof. The work table includes spaced side sections defining an aisle and a longitudinal center section normally biased to fill the aisle, but which may be urged toward the coating and cutting stations by body pressure from the waist of the operator and, as the operator walks the covering backward, the center section follows in continuous resumption of its first position to cooperate with the side sections to form a platform for supporting the coated wall covering.

9 Claims, 5 Drawing Figures

APPARATUS FOR COATING AND CUTTING SHEET MATERIAL

BACKGROUND AND BRIEF SUMMARY OF THE INVENTION

The hanging of wall covering material still remains an essentially manual operation which depends largely upon the skill and experience of the person performing the work. However, certain of the steps involved can and have been aided by special equipment. For example, numerous devices for applying the adhesive have been proposed as, for example, in accord with the following U.S. patents:

| | | |
|---|---|---|
| 2,352,978 | Shoemaker | July 4, 1944 |
| 2,496,581 | Drienka | February 7, 1950 |
| 2,514,238 | Hesson | July 4, 1950 |
| 3,054,381 | Meichtry | September 18, 1962 |
| 3,389,680 | Moore | June 25, 1968 |
| 3,924,561 | Ruthart et al. | December 9, 1975 |
| 4,300,471 | Desjardins | November 17, 1981 |
| 4,377,983 | Skarsten | March 29, 1983 |

Some of the above patents suggest also some form of support or holder for the wall covering material after it has been coated with paste, as an aid in the manipulation necessary to effect skilled hanging. Some machines have also incorporated cutting devices both for cutting a covering strip to desired length after being coated (see particularly the Moore Pat. No. 3,389,680) whereas longitudinal cutting devices have also been proposed (see Drienka Pat. No. 2,496,581).

The invention disclosed in this application is, unlike the prior art, a complete machine which includes an adhesive coating station having supply roll supports, a transverse cutting station and a generally horizontal support station for the coated, cut strip which is ready for hanging and wherein such machine can be dismantled or knocked down not only to provide for ready transportation and storage but also so as to break it down into small, easily handled components which greatly facilitate washing and cleaning thereof.

The knock down feature is also important to allow the components making up the machine to be sized so that they are easily and readily placed in a convenient transport vehicle such as a stationwagon, a pickup truck or a van.

This invention relates to wall coverings and more particularly, to a portable apparatus for coating a wall covering with paste and cutting the covering at its desired length. The machine includes paste hopper applicator means and means for making a transverse cut to thereby separate a strip of wall covering ready for hanging. The paste and cut mechanisms are fixed to an articulated foldable work table generally at one end thereof. The table includes spaced side sections defining an aisle and a longitudinal center section normally biased to fill the aisle but which may be urged toward the paste and cut work area by body pressure from the waist of the operator and, as the operator walks the covering backward, the center section follows in continuous resumption of its first position to cooperate with the side sections to form a platform for supporting the coated covering strip. A switch is located on the table at the end distal the paste and cut stations to energize a motor which pulls the knife through one pass transversely across the covering material to thereby separate it from the roll. The coated and cut section of wall covering is then ready to be hung on a wall.

DESCRIPTION OF THE ILLUSTRATIVE EMBODIMENT

Figure 1:
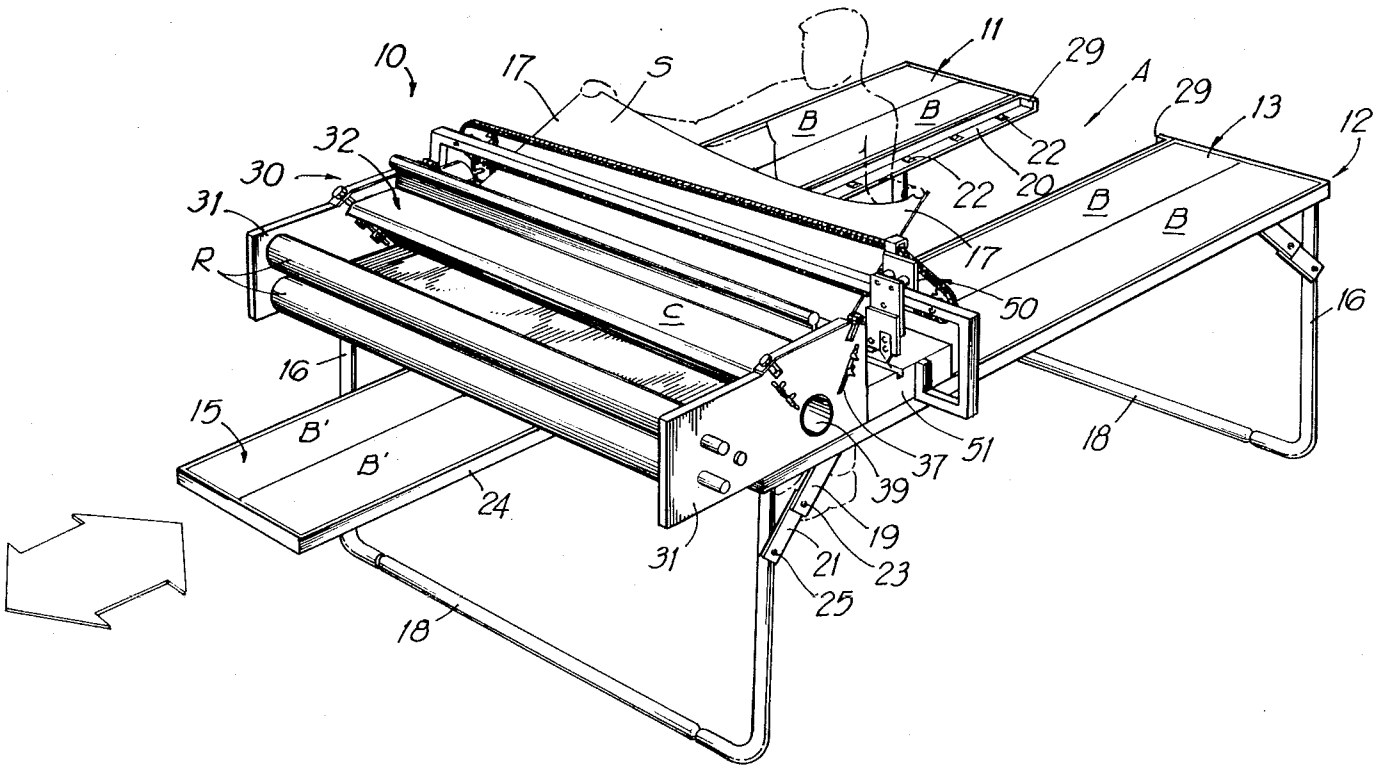
FIG. 1 is a perspective view of the present invention.

Referring now to the drawings, and particularly FIG. 1, the numeral 10 denotes generally the present invention which includes a work table station 12, a coating station 30 including means for supporting one or more rolls R of the wall covering material, and a cutting station 50. The work table station 12 includes a pair of elongate, generally horizontal and transversely spaced table side portions 11 and 13 which are fixed relative to each other so as to define an aisle A as indicated. A center section 15 bridges the gap between the side portions 11 and 13 and is moveable relative thereto so as to allow a person to enter the aisle and approach the cutting station 30 (see the person illustrated by phantom lines in FIG. 1) while engaging and pushing the movable table center section means 15 ahead of him. As will appear later, the person may grasp the corners 17 of a strip S of wall covering material and proceed to back down the aisle A while the means 15 follows him to fill the aisle and position the coated strip on the full width of the table support afforded by the portions 11 and 13 and the intervening means 15. For this purpose, as will be described later, a biasing means preferably in the form of a return spring mechanism normally urges the means 15 to the requisite intervening position.

The two portions 11 and 13 each consist of a side-by-side pair of wooden or similar panels B, B affixed to and supported by a circumscribing angle iron frame. For example, these two frames are indicated at 14, 14 in FIG. 2. On the inner side portions of these frames 14, 14 there is provided the two additional angle iron pieces 20, 20 whose horizontal projections may be provided with rollers 22 for supporting the means 15 for smooth and generally frictionless movement. Also shown is the angle iron frame 24 for the table center section or movable means 15 which, as in the case for the fixed table portions 11 and 13, supports and affixes a further pair of panels B' as shown.

Figure 2:
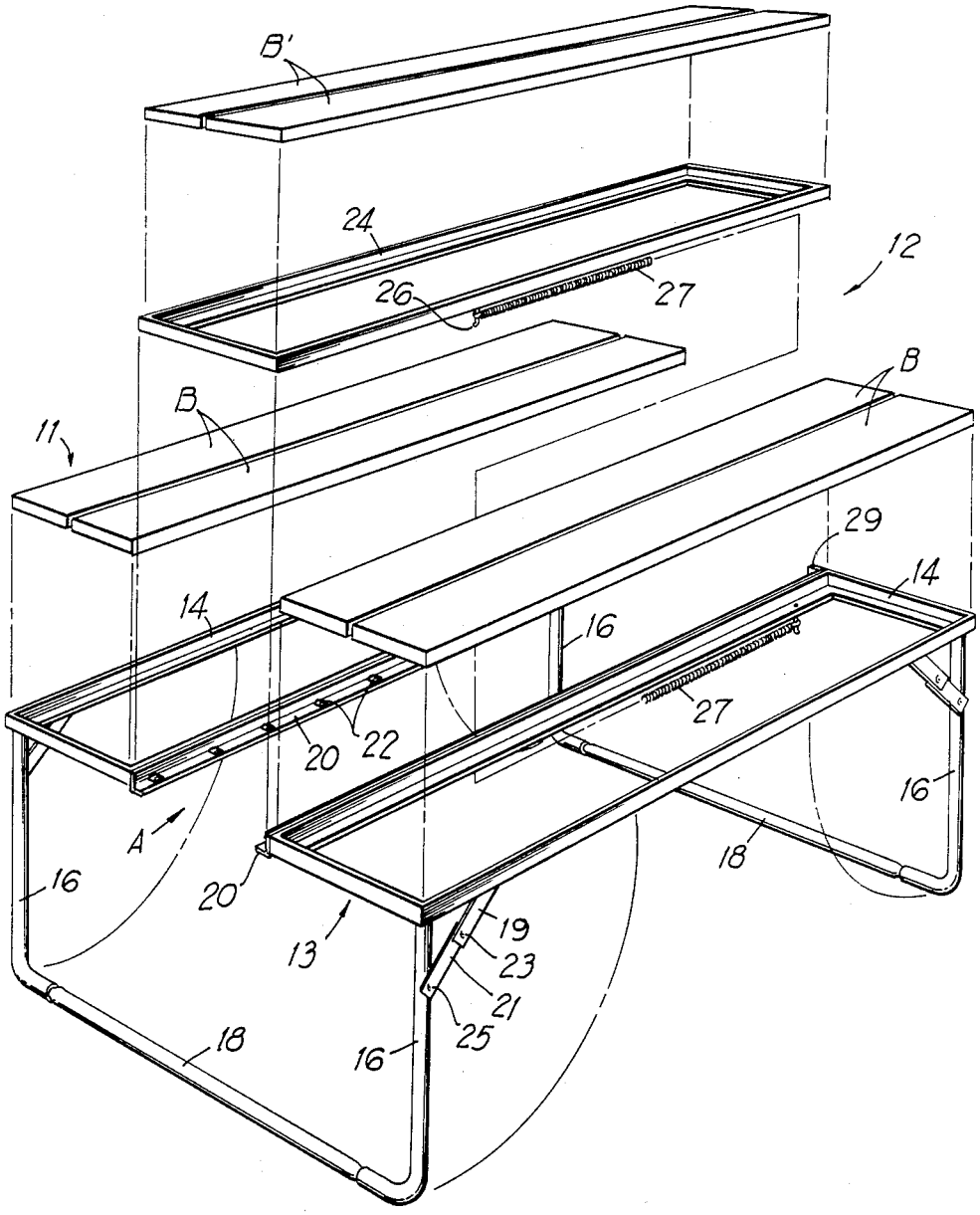
FIG. 2 is an exploded perspective view of the work table portion of the present invention shown in FIG. 1.

FIG. 2 illustrates the preferred return spring 27 which is anchored at 28 to a side portion frame 14 and, at its other end, to frame 24 at 26. The angles 20 are provided with stops 29 at one end of the aisle A to retain means 15 in its normally biased rest position. In its preferred form return spring 27, when connecting means 15 to frame 14, always retains at least a portion of the means 15 within the angle iron pieces 20, 20. Of course, a second spring (not shown) may be employed similarly to spring 27 on the side of frame 24 opposite spring 27 as shown.

In the embodiment of FIG. 2, the two frames are joined by the L shaped leg elements 16, 16 and the intermediate members 18. The legs 16 are pivotally attached to their frames 14 and are provided with hinge links 19, 21. Each link 19 is pivoted (not shown) at one end to a frame 14 and at its opposite end to the other link 21 as indicated at 23. The links 21 are pivoted to their corresponding legs 16 at 25. The entire assembly may be readied for storage or transport by swinging the legs 16 upwardly under the table assembly as indicated by the dashed lines in FIG. 2. Preferably, this table or base assembly may be knocked down further to generate easily transported and stored component parts by separating the sections 18 from the legs 16 and disconnecting the return spring 27 either from frame 24 or frame 14.

Also, it should be appreciated that upon completion of use and removal of the machine 10, the coating mechanism 30 and the cutting mechanism 50 can be unbolted and carried away. Hence, the center frame section 24 is un-sprung and removed—the leg connecting segments 18 are pulled and the legs 16 are folded into frames 14 to facilitate removal of the structure.

Figure 3:
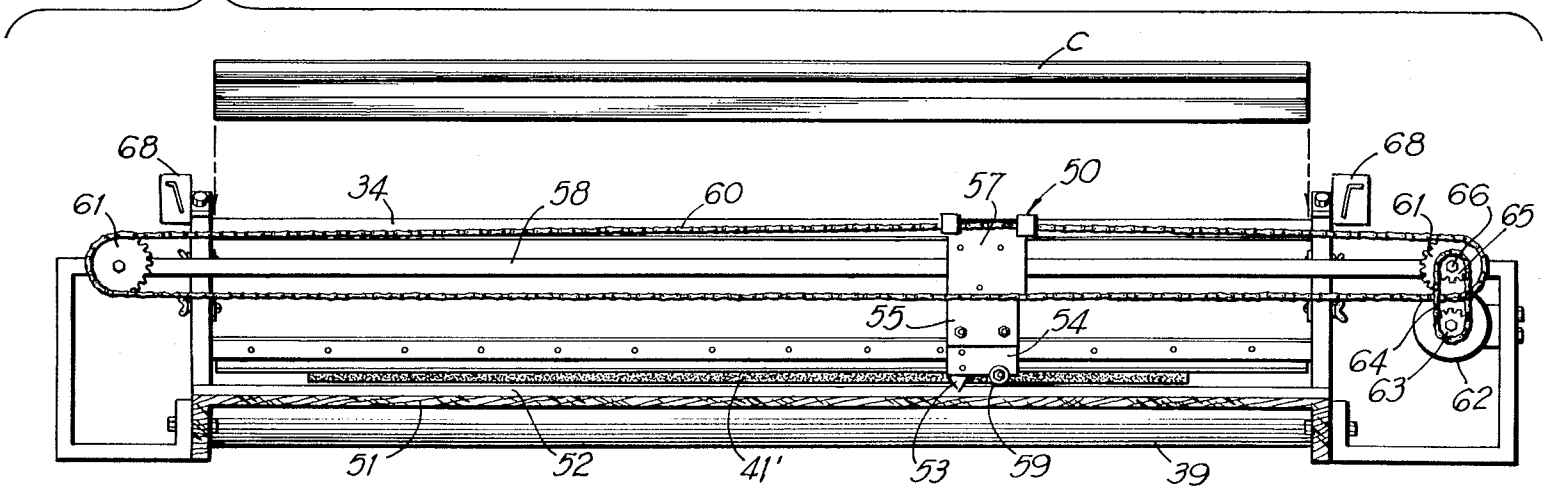
FIG. 3 is a cross-sectional view of the coating and cutting stations of the present invention shown in FIG. 1.

Referring now to the coating station 30, a pair of vertical side members 31 sandwich and provide end walls for a trough-like paste hopper 32, including the convergent walls 33 and 34, FIG. 3. The walls 33 and 34 are detailed with angle members 35 having screws 36 which are slidable through the slots 37. Disposed above each wall 33 and 34 on each end is a set screw 38 which, in cooperation with members 35, screws 36 and slots 37, operate to set the depth and selectively control the width of the gap between the walls 33 and 34 and a surface bearing tube or backing member 39. Once the gap has been determined, the screws 36 are tightened to maintain the desired setting.

Disposed on each lower edge of each hopper wall 33 and 34 are the flexible strips 41 and 41' constructed of any resilient material and which act as seals to control the desired thickness of adhesive P being applied to the wall covering strip S. The wall covering is pulled off of a roll R which is supported between walls 31 of the coating station 30 on spring loaded dowel pins (not detailed, but similar to that structure in a toilet paper dispenser). A guide rod 43 is positioned forward of and in line with the entrance slot of the paste hopper 32 to direct the covering material smoothly therethrough.

A second roll R of wall covering is supported below the primary roll to thereby allow the material to be replenished without having to stop to reload. Therefore, a worker can continuously paste and cut sections of wall covering and upon reaching the end of one roll, simply re-insert an edge of the new roll by taping the loading edge of the new roll to the trailing edge of the old roll and pull it through the paste hopper 32. A new roll may then be placed on the spare spool for eventual use. A cover C can be placed over the paste hopper 32 to keep the hopper free of dust and debris and also maintain a moist atmosphere. It might be preferable also to have the cover material transparent so as to enable the operator to know when to replenish the paste in the hopper.

Figure 4:
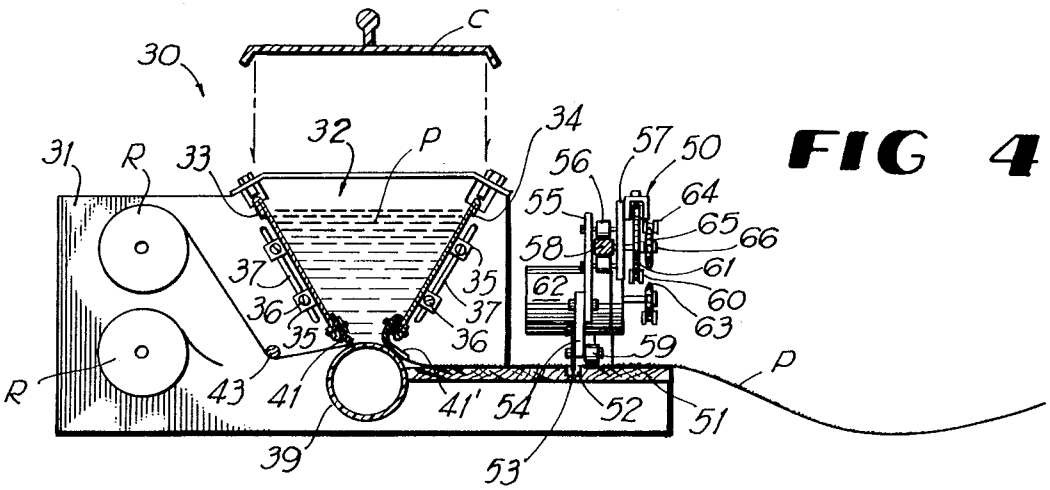
FIG. 4 is an end elevational view of the cutting station of the present invention shown in FIG. 1, partially exploded.

As seen in FIG. 1 and more detailed in FIGS. 3 and 4, a cutting mechanism 50 rests adjacent the coating station 30 forward of the paste hopper 32 over a platform 51. The platform 51 is positioned at a height to receive the feed of covering material out of the hopper. The platform is detailed with a slot 52 which is of sufficient width to allow the pass of a triangular double edged razor blade 53. Blade 53 is fixed to a plate 54 which can be selectively adjusted to establish the depth of the blade 53 to sever the cover material. Plate 54 is fixed to a plate 55. A set of roller bearings 56 are fixed to plate 55 and thence to opposite plate 57 to thereby encompass a square table monorail track 58. A lower roller 59 is spring loaded off of blade holder 54 to bias against the material to be cut to thereby stabilize the material while the blade is passing through its cut. The blade carriage assembly 53–59 is fixed to an endless chain 60 which is sprocketed at 61 on each end and driven through a reversable motor 62 driving through a motor sprocket 63 via drive chain 64 which is flighted around sprocket 65 on the axle 66 of one sprocket 61. A switch (not shown) is preferably located on the work table 12 at the end distal the coating and cutting stations 30, 50 for energization of the motor 62.

In operation the covering is passed through the paste hopper over the backing member 39. Paste or other suitable adhesive is applied directly on the back of the covering material between the flexible strips 41, 41' and the material is pulled to the desired length. The operator then energizes motor 62 to draw the knife 53 across the table to sever the material. Limit switches 68 on each end of the track de-energize the motor 62 and automatically reverse the direction of the motor to ready it for the next pass of the blade in the opposite direction.

Figure 5:
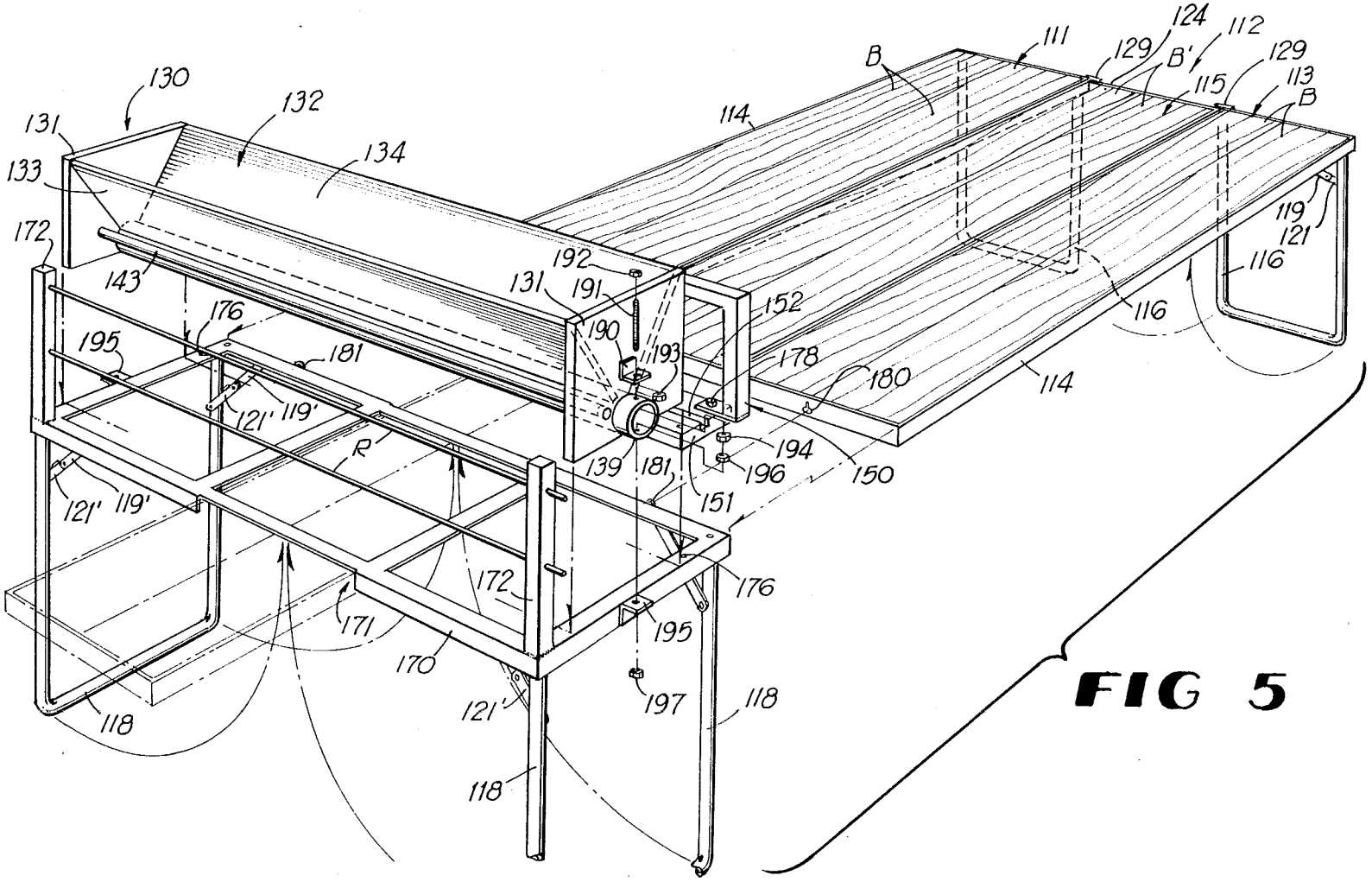
FIG. 5 is an exploded perspective view of an alternate embodiment of the present invention.

An alternate embodiment of the present invention, yet similar in operation to the embodiment of FIGS. 1–4, is shown in FIG. 5, wherein the work table 112 has been modified to shorten its length allowing for greater ease of transportation in pickup trucks and the like having shorter beds. The work table 112, like table 12, has side portions 111, 113 generally defined by angle iron frames 114 supporting panels B, B. At one end of the side portions 111, 113 are leg elements 116, 116 individually pivotally mounted to each side portion. The leg elements 116, 116 are provided with hinge links 119, 121 similar to the hinge links 19, 21 of leg elements 16 and collapsable in the same manner.

Disposed between the side portions 111, 113 is a center section 115 defined by angle iron frame 124 supporting panel B'. The center section 115 is moveably biased relative to the side portions 111, 113 in the same manner as center section 15 of FIGS. 1 and 2 and held in position at rest by stops 129.

A separate generally horizontal, rectangularly shaped frame 170 supports the coating station 130, the platform 151 and the cutting station 150. At opposite sides of the frame 170 are leg elements 118, 118 individually pivotally mounted thereto. Leg elements 118, 118 are also provided with hinge links 119', 121'.

At one end of the frame 170 are provided a pair of rivots 181 for mating with eyelets 180 on the end of the side portion frames 114, 114 opposite the leg members 116, 116, and thereby securing the work table 112 to frame 170. A recess 171 is provided through the center of frame 170 for receiving center section 115 when the section 115 is pressed toward the coating and cutting stations 130, 150, as shown in phantom lines. Standing upright from the frame 170 at the end opposite rivots 180 are posts 172 for supporting rods R which may carry rolls of the wall covering material to be coated with paste from the coating station 130.

The coating station 130 includes the hopper 132 defined by convergent walls 133 and 134 held in place by side members 131, 131. The lower ends of the convergent walls 133, 134 define the opening (not shown)

through which the paste or other adhesive is applied to the wall covering material. Disposed directly beneath the hopper opening is backing member 139. Flexible strips are again provided, similar to flexible strips 41 and 41', which act as seals to control the desired thickness of paste being applied to the wall covering material. Each end of the backing member 139 is secured to the bracket 190 on side walls 131 by a threaded bolt 191 and nuts 192, 194. The amount of clearance between the backing member 139 and the opening at the bottom of walls 133 and 134 is adjustable by nut 193 in cooperation with nut 192. A guide rod 143, also held by side members 131, is again positioned forward of and in line with the entrance slot of the hopper 132 to direct the covering material smoothly therethrough. The coating station 130 is mounted to frame 170 by the same bolt 191 in cooperation with bracket 195 and nut 197.

Forward of the coating station 130, toward the work table 112, a platform 151 having guide slot 152 is mounted on frame 170 at 176. A cutting station 150, similar in construction to cutting station 50, is mounted onto platform 151 at 178. The platform 151 and the cutting station 150 may be permanently mounted to the frame 170.

It is to be understood that the forms of the invention herewith shown and described are to be taken as preferred examples of the same, and that various changes in the shape, size and arrangement of parts may be resorted to, without departing from the spirit of the invention or scope of the subjoined claims.

What I claim is:

1. A machine for applying adhesive to a strip of wall covering material while the strip is being payed from a supply roll of the material to form a coated strip of desired length ready for hanging and for cutting such strip transversely to the desired length, said machine comprising a pair of elongate, generally horizontal and transversely spaced table portions defining an aisle into one end of which a person may enter to walk toward the opposite end of the aisle, support means adjacent said opposite end of the aisle for rotatably supporting a supply roll of wall covering material, means also adjacent said opposite end of the aisle for coating the upper side of said strip with adhesive as it is payed from the supply roll in response to a person grasping an end of the strip and transporting it while walking within the aisle toward said one end thereof, and movable table means bridging said aisle for allowing a person to enter the aisle and progress toward said opposite end thereof and for progessively filling in and bridging the aisle as a person progresses from said opposite end to and through said one end of the aisle.

2. A machine as defined in claim 1 including cutting means adjacent said opposite end of the aisle and forward of said means for coating said strip for effecting a transverse cut on the strip as the strip is supported at least in major part by said table portions and said movable table means.

3. A machine as defined in claim 2 including biasing means for normally urging said movable table means into aisle filling position while allowing a person to urge such movable table means ahead of such person while walking into said aisle and toward said opposite end thereof.

4. A machine as defined in claim 3 including detachable base means for allowing said pair of table portions and said movable table means to be separated for storage and transportation.

5. A machine as defined in claim 4 wherein said detachable base means comprises a frame adapted to be removed from said table portions and to which said means for coating, said cutting means and said support means are mounted.

6. A device as defined in claim 2 wherein said cutting means includes a platen overlying said table portions and said movable table means at said opposite end of the aisle.

7. A device as defined in any one of claims 1–6 wherein said means for coating comprises a hopper presenting an open slot at its bottom, a backing member underlying said slot and flexible strips along opposite edges of said slot and depending toward contact with said backing member to close the bottom of the hopper whereby the wall covering material may be passed under said strips and over said backing member to expose the upper surface of the wall covering material directly to wetting by adhesive confined within said hopper.

8. A machine as defined in any one of claims 1–6 wherein said means for coating comprises a trough-like hopper having downwardly convergent front and rear walls defining an open bottom slot therebetween and a pair of opposite end walls between which said front and rear wall span to define the trough-like hopper, a backing member also spanning between said end walls and aligned below said bottom slot but in spaced relation therebelow, and a pair of flexible strips fixed to and depending from said front and rear walls and extending to said backing member whereby the upper surface of the strip of wall covering material between said flexible strips and threaded over said backing member is directly exposed to contact with a supply of adhesive disposed within said trough-like hopper.

9. A device for applying adhesive to the surface of a strip of wall covering material, comprising a trough-like hopper having downwardly convergent front and rear walls defining an open bottom slot therebetween and a pair of opposite end walls between which said front and rear walls span to define the trough-like hopper, a cylindrical backing member also spanning between said end walls and aligned below said bottom slot but in spaced relation therebelow, and a pair of flexible strips fixed to and depending from said front and rear walls and extending to said backing member whereby the upper surface of the strip of wall covering material between said flexible strips and threaded over said backing member is directly exposed to contact with a supply of adhesive disposed within said trough-like hopper.

* * * * *